US012790789B2

(12) United States Patent
Kozui et al.

(10) Patent No.: US 12,790,789 B2
(45) Date of Patent: Nov. 10, 2026

(54) WORK MACHINE CONTROL SYSTEM, WORK MACHINE, MANAGEMENT DEVICE, AND WORK MACHINE CONTROL METHOD

(71) Applicants: HIROSHIMA UNIVERSITY, Higashi-Hiroshima (JP); KOBELCO CONSTRUCTION MACHINERY CO., LTD., Hiroshima (JP)

(72) Inventors: Masatoshi Kozui, Hiroshima (JP); Toru Yamamoto, Hiroshima (JP); Hideo Yoshihara, Hiroshima (JP); Kazushige Koiwai, Hiroshima (JP)

(73) Assignees: HIROSHIMA UNIVERSITY, Higashi-Hiroshima (JP); KOBELCO CONSTRUCTION MACHINERY CO., LTD., Hiroshima (JP)

( * ) Notice: Subject to any disclaimer, the term of this patent is extended or adjusted under 35 U.S.C. 154(b) by 209 days.

(21) Appl. No.: 18/699,998

(22) PCT Filed: Oct. 13, 2022

(86) PCT No.: PCT/JP2022/038182
§ 371 (c)(1),
(2) Date: Nov. 1, 2024

(87) PCT Pub. No.: WO2023/068154
PCT Pub. Date: Apr. 27, 2023

(65) Prior Publication Data

US 2025/0067021 A1 Feb. 27, 2025

(30) Foreign Application Priority Data

Oct. 19, 2021 (JP) ..... 2021-171230

(51) Int. Cl.
*E02F 9/20* (2006.01)
*E02F 9/26* (2006.01)

(52) U.S. Cl.
CPC ..... *E02F 9/205* (2013.01); *E02F 9/268* (2013.01)

(58) Field of Classification Search
CPC ..... E02F 9/205; E02F 9/268
See application file for complete search history.

(56) References Cited

U.S. PATENT DOCUMENTS 9,441,348 B1 9/2016 Alig et al.
2016/0289926 A1 10/2016 Alig et al.
(Continued)

FOREIGN PATENT DOCUMENTS

CN 108350680 A 7/2018
CN 111094663 A 5/2020
(Continued)

OTHER PUBLICATIONS

Extended European Search Report Issued Dec. 6, 2024 in European Patent Application No. 22883458.6, 11 pages.
(Continued)

*Primary Examiner* — Rodney A Butler
(74) *Attorney, Agent, or Firm* — Oblon, McClelland, Maier & Neustadt, L.L.P.

(57) ABSTRACT

A controller of a work machine control system stores a plurality of data groups including manipulation ability past data and control parameter past data associated with the manipulation ability past data, determines manipulation ability of an operator, sets a control parameter using operation information that is information including the manipulation ability and using the plurality of data groups, calculates an assist amount for assisting the manipulation by the operator using the control parameter, calculates a control command for operating an object to be controlled using a manipulation amount of manipulation given to a manipula-
(Continued)

tion device and using the assist amount, and inputs the control command to the object to be controlled.

10 Claims, 7 Drawing Sheets

(56) References Cited

U.S. PATENT DOCUMENTS

| | | | | |
|---|---|---|---|---|
| 2018/0106016 | A1 | 4/2018 | Uji et al. | |
| 2018/0347149 | A1 | 12/2018 | Tomita et al. | |
| 2020/0048866 | A1 | 2/2020 | Weber et al. | |
| 2020/0263394 | A1 | 8/2020 | Daimon et al. | |
| 2021/0262190 | A1* | 8/2021 | Ito | E02F 9/205 |
| 2021/0332561 | A1 | 10/2021 | Kozui et al. | |

FOREIGN PATENT DOCUMENTS

| | | | |
|---|---|---|---|
| JP | 1-127731 | A | 5/1989 |
| JP | 2001-142506 | A | 5/2001 |
| JP | 2011-157789 | A | 8/2011 |
| JP | 2017-75500 | A | 4/2017 |
| JP | 2020-33815 | A | 3/2020 |
| JP | 2020-84435 | A | 6/2020 |
| JP | 2021-80657 | A | 5/2021 |
| WO | WO 2017/168687 | A1 | 10/2017 |

OTHER PUBLICATIONS

International Search Report mailed Nov. 22, 2022 in PCT/JP2022/038182 filed on Oct. 13, 2022, 3 pages.
Combined Chiense Office Action and Search Report issued on May 19, 2026 in Chinese Patent Application No. 202280069149.8 (with unedited computer-generated English Translation).

* cited by examiner

FIG.5

PAST DATA GROUP

| | WORK CONTENT DETERMINATION RESULT | MANIPULATION ABILITY DETERMINATION RESULT | CONTROL PARAMETER | OPERATOR |
|---|---|---|---|---|
| DATA GROUP A | EXCAVATING AND LOADING | 50 | PRa | OPa |
| DATA GROUP B | EXCAVATING AND LOADING | 80 | PRb | OPb |
| DATA GROUP C | FLAT GROUND LEVELING | 60 | PRc | OPa |
| DATA GROUP D | SLOPE SURFACE LEVELING | 40 | PRd | OPb |
| DATA GROUP E | FLAT GROUND LEVELING | 70 | PRe | OPa |
| DATA GROUP F | SLOPE SURFACE LEVELING | 70 | PRf | OPa |
| ... | ... | ... | ... | ... |
| ... | ... | ... | ... | ... |

FIG.6

CURRENT OPERATION INFORMATION

| OPERATOR | WORK CONTENT DETERMINATION RESULT | MANIPULATION ABILITY DETERMINATION RESULT | TARGET MANIPULATION ABILITY |
|---|---|---|---|
| OPc | EXCAVATING AND LOADING | 55 | 65 |

WORK MACHINE CONTROL SYSTEM, WORK MACHINE, MANAGEMENT DEVICE, AND WORK MACHINE CONTROL METHOD

TECHNICAL FIELD

The present disclosure relates to a work machine control system, a work machine, a management device, and a work machine control method.

BACKGROUND ART

Each of Patent Literatures 1 to 3 discloses a technique for assisting manipulation of an operator in order to improve work efficiency at a work site.

Patent Literature 1 discloses a technique of measuring or calculating a motion state amount of a combined center of gravity of a boom, an arm, and a bucket constituting a work device, determining an instruction value for an operation mechanism of the work device using feedback control such that the motion state amount follows a predetermined first target value, and adjusting a manipulation amount of an operator for the work device based on the instruction value.

Patent Literature 2 discloses a control parameter change system for a construction machine that changes a control parameter incorporated in a control device that controls a device that drives an actuator of a construction machine according to a request of the user of the construction machine. A storage device of a management server of this system stores a plurality of control parameter sets having different characteristics and user request information including a request regarding operability of the user of a hydraulic excavator. The management server extracts a control parameter set matching a request of the user from the control parameter sets on the basis of the user request information, and outputs the extracted control parameter set, having been extracted, to the hydraulic excavator. An information controller of the hydraulic excavator changes a control parameter set incorporated in the control controller to the extracted control parameter set.

Patent Literature 3 discloses an output characteristic changing system for a construction machine. A storage device of a management server of this system stores an operator ID, a vehicle ID, and output characteristic information in association with operability desired by each operator. The management server extracts output characteristic information matching operability desired by an operator from an operator ID and a vehicle ID, and outputs the extracted output characteristic information to a hydraulic excavator. A control device for the hydraulic excavator changes an output characteristic of a hydraulic actuator on the basis of output characteristic information stored in a memory.

Since manipulation ability of manipulating a work machine is different for each operator, it is desirable to perform assistance according to manipulation ability. However, in the technique of Patent Literature 1, since manipulation ability of an operator is not taken into consideration, there is a case where work efficiency is not always improved depending on manipulation ability of an operator.

Further, while manipulation ability of each operator is improved through various work experiences, the manipulation ability may decrease, for example, as a period during which no work is performed becomes long. That is, manipulation ability of each operator may change. In the technique of Patent Literature 2, a control parameter set matching a request from the user is extracted from control parameter sets on the basis of user request information including a request regarding operability of the user stored in advance. Therefore, in the technique of Patent Literature 2, in a case where manipulation ability of an operator changes, assistance according to the manipulation ability of the operator cannot be performed, and there is a case where work efficiency is not improved. Similarly, in the technique of Patent Literature 3, an operator ID, a vehicle ID, and output characteristic information are stored in advance in association with operability desired by each operator, the output characteristic information is extracted based on the operator ID and the vehicle ID, and the extracted output characteristic information is output to a hydraulic excavator. Therefore, in the technique of Patent Literature 3, in a case where manipulation ability of an operator changes, assistance according to the manipulation ability of the operator cannot be performed, and there is a case where work efficiency is not improved.

CITATION LIST

Patent Literature

Patent Literature 1: JP 2020-033815 A
Patent Literature 2: JP 2017-075500 A
Patent Literature 3: WO 2017/168687 A

SUMMARY OF INVENTION

An object of the present disclosure is to provide a work machine control system, a work machine, a management device, and a work machine control method capable of appropriately assisting manipulation by an operator given to a manipulation device of the work machine according to manipulation ability of the operator.

Provided is a control system for controlling a work machine, the work machine control system including a manipulation device to which manipulation for operating an object to be controlled in the work machine is given by an operator, and a controller, in which the controller stores a plurality of data groups related to past work, each of the plurality of data groups including manipulation ability past data and control parameter past data associated with the manipulation ability past data, determines manipulation ability of the operator, sets a control parameter by using the plurality of data groups and operation information that is information including the manipulation ability, calculates, by using the control parameter, an assist amount for assisting the manipulation by the operator, and calculates a control command for operating the object to be controlled by using the assist amount and a manipulation amount of the manipulation given to the manipulation device, and inputs the control command to the object to be controlled.

A work machine to be provided includes a manipulation device to which manipulation for operating an object to be controlled in a work machine is given by an operator, and a work machine controller, in which the work machine controller determines manipulation ability of the operator sets a control parameter by using at least one data group selected, from a plurality of data groups related to past work, according to operation information that is information including the manipulation ability, each of the plurality of data groups including manipulation ability past data and control parameter past data associated with the manipulation ability past data, calculates, by using the control parameter, an assist amount for assisting the manipulation by the operator, and calculates a control command for operating the object to be controlled by using the assist amount and a manipulation amount of the manipulation given to the manipulation device, and inputs the control command to the object to be controlled.

Provided is a management device used in the work machine control system and arranged at a place away from the work machine, the management device including a data group storage part that stores the plurality of data groups.

Provided is a work machine control method for assisting manipulation by an operator for operating an object to be controlled in a work machine, the work machine control method including: storing a plurality of data groups related to past work, each of the plurality of data groups including manipulation ability past data and control parameter past data associated with the manipulation ability past data, determining manipulation ability of the operator, setting a control parameter by using the plurality of data groups and operation information that is information including the manipulation ability, calculating, by using the control parameter, an assist amount for assisting the manipulation by the operator, and calculating a control command for operating the object to be controlled by using a manipulation amount of the manipulation and the assist amount, and inputting the control command to the object to be controlled.

BRIEF DESCRIPTION OF DRAWINGS

FIG. 5 is a diagram illustrating an example of a plurality of past data groups stored in the work machine control system.

FIG. 6 is a diagram illustrating an example of operation information of the work machine.

DESCRIPTION OF EMBODIMENTS

Figure 1:
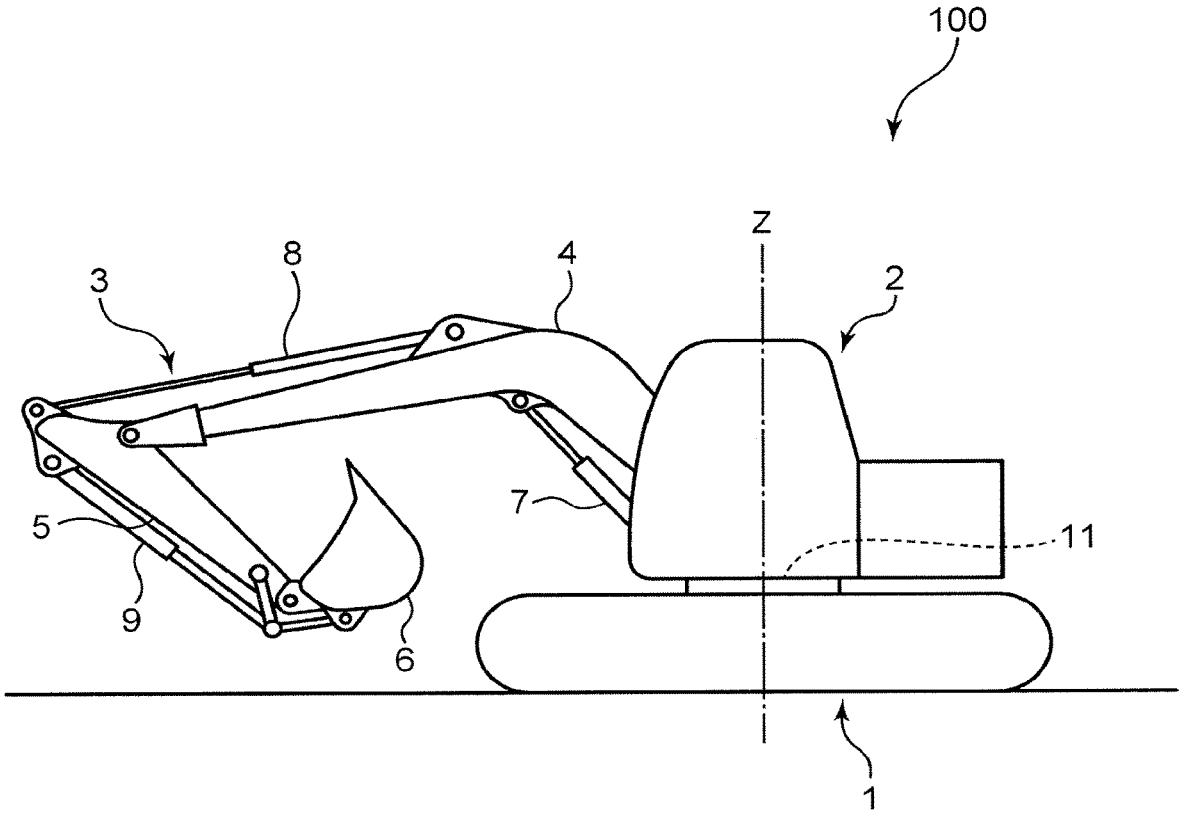
FIG. 1 is a side view illustrating an example of a work machine according to an embodiment of the present disclosure.
Figure 2:
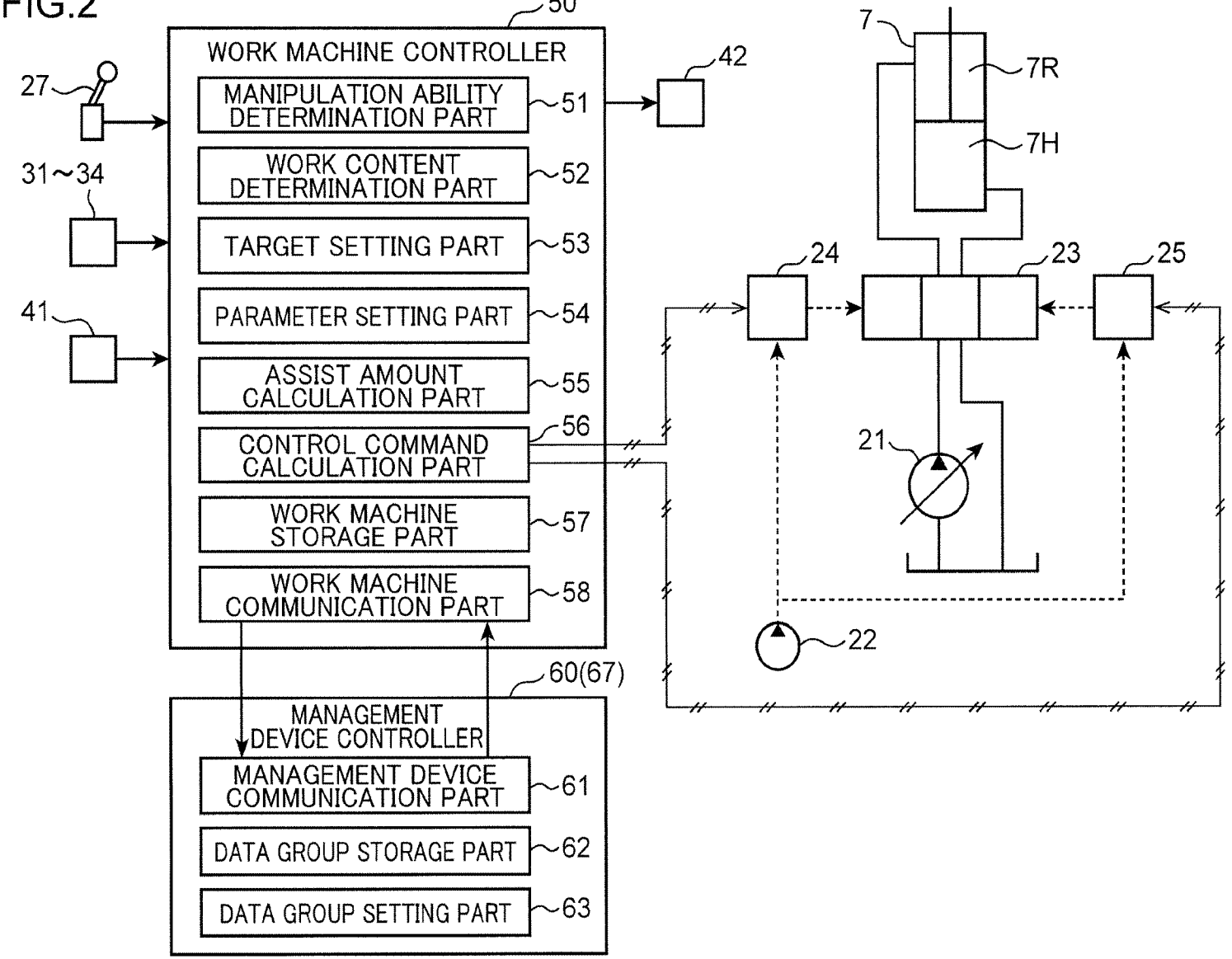
FIG. 2 is a diagram illustrating a part of a hydraulic circuit of the work machine and a controller.
Figure 3:
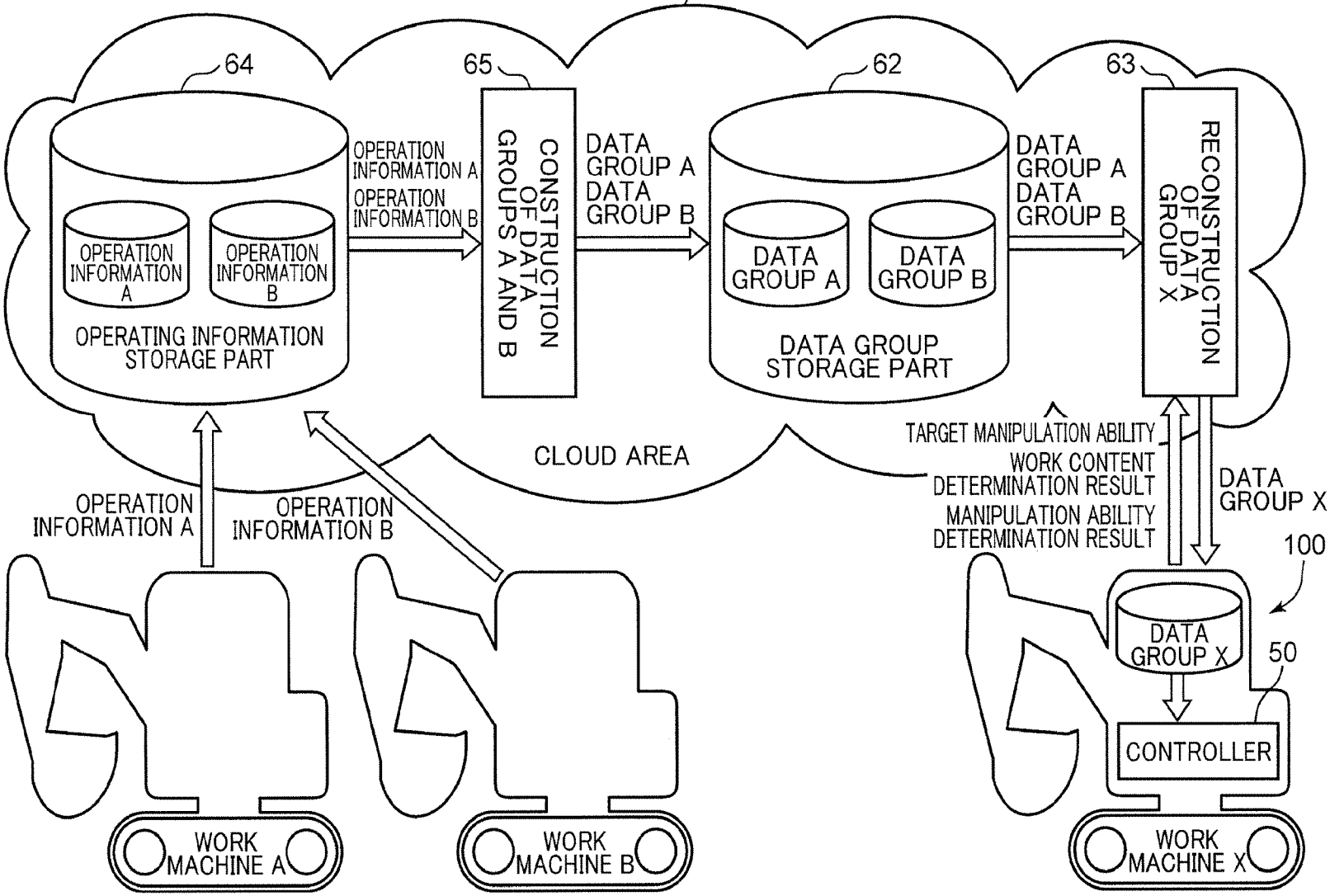
FIG. 3 is a conceptual diagram illustrating a work machine control system according to the embodiment of the present disclosure.

Hereinafter, an embodiment of the present disclosure will be described with reference to the drawings. FIG. 1 is a side view illustrating a work machine 100 according to the present embodiment. In the present embodiment, the work machine 100 is a hydraulic excavator which is an example of a work machine including an object to be controlled. FIG. 2 is a diagram illustrating a part of a hydraulic circuit of the work machine 100 and a controller of a work machine system. FIG. 3 is a conceptual diagram illustrating a work machine control system according to the embodiment. The work machine control system includes the work machine 100 and a management device 60. In the present embodiment, the management device 60 is a server that is arranged at a place away from the work machine 100 and can provide a specific function and various pieces of data to the work machine 100 in response to a command from the work machine 100.

The work machine system according to the present embodiment includes a controller that controls operation of the work machine system. In the present embodiment, as illustrated in FIG. 2, the controller includes a work machine controller 50 included in the work machine 100 and a management device controller 67 included in the management device 60. Note that the work machine controller 50 may have a part or all of functions of the management device controller 67 in addition to a function of the work machine controller 50. In a case where the work machine controller 50 has a part or all of functions of the management device controller 67, the controller of the work machine system only needs to include at least the work machine controller 50, and does not need to include the management device controller 67.

As illustrated in FIGS. 1 and 2, the work machine 100 includes a lower travelling body 1 capable of self-travelling, an upper slewing body 2 supported by the lower travelling body 1 so as to be slewable about a Z axis in a vertical direction, a work device 3, a plurality of hydraulic actuators, a plurality of hydraulic pumps, a plurality of control valves, a plurality of manipulation devices, a plurality of proportional valves, a plurality of detectors, a target input device 41, a display 42, and the work machine controller 50.

The upper slewing body 2 includes an upper frame slewably supported by the lower travelling body 1, a cabin supported by the upper frame, and a counterweight arranged behind the cabin.

The work device 3 includes a boom 4 supported by the upper frame in a derrickable manner, an arm 5 rotatably supported by a tip portion of the boom 4, and a bucket 6 rotatably supported by a tip portion of the arm 5.

A plurality of hydraulic actuators include a boom cylinder 7, an arm cylinder 8, a bucket cylinder 9, and a slewing motor 11.

A plurality of hydraulic pumps include a hydraulic pump 21 (first hydraulic pump) illustrated in FIG. 2, a second hydraulic pump (not illustrated), and a pilot pump 22 illustrated in FIG. 2. Each of the first and second hydraulic pumps supplies hydraulic oil to at least one of a plurality of hydraulic actuators. Each of the first hydraulic pump 21 and the second hydraulic pump includes, for example, a hydraulic pump of a variable capacity type. The pilot pump 22 supplies pilot pressure to each of a plurality of control valves. Each of a plurality of hydraulic pumps is driven by, for example, an engine (not illustrated).

In FIG. 2, only a circuit for operating the boom cylinder 7 is illustrated as a representative, and illustration of a circuit for operating the arm cylinder 8, the bucket cylinder 9, and the slewing motor 11 is omitted. A basic structure of a circuit for operating each of the arm cylinder 8, the bucket cylinder 9, and the slewing motor 11 is similar to the circuit for operating the boom cylinder 7 illustrated in FIG. 2.

The boom cylinder 7 is a hydraulic cylinder that receives supply of hydraulic oil from the hydraulic pump 21 illustrated in FIG. 2 and operates to cause the boom 4 to perform derricking operation with respect to the upper slewing body 2. A base end portion of the boom cylinder 7 is rotatably attached to an upper frame of the upper slewing body 2, and a tip portion of the boom cylinder 7 is rotatably attached to the boom 4. As illustrated in FIG. 2, the boom cylinder 7 includes a rod chamber 7R and a head chamber 7H.

The arm cylinder 8 is a hydraulic cylinder that receives supply of hydraulic oil from one of the first and second hydraulic pumps and operates to rotate the arm 5 with respect to the boom 4. The bucket cylinder 9 is a hydraulic cylinder that receives supply of hydraulic oil from one of the first and second hydraulic pumps and operates to rotate the bucket 6 with respect to the arm 5. The slewing motor 11 is a hydraulic motor that receives supply of hydraulic oil from one of the first and second hydraulic pumps and operates to slew the upper slewing body 2 with respect to the lower travelling body 1.

A plurality of control valves include a boom control valve 23 illustrated in FIG. 2, an arm control valve (not illustrated), a bucket control valve (not illustrated), and a slewing control valve (not illustrated). Each of the plurality of control valves has a spool and a pair of pilot ports that receive pilot pressure from the pilot pump 22.

The boom control valve 23 is interposed between the hydraulic pump 21 and the boom cylinder 7, and performs opening and closing operation to change a direction and a flow rate of hydraulic oil supplied to the boom cylinder 7. The arm control valve is interposed between one of the first and second hydraulic pumps and the arm cylinder 8, and performs opening and closing operation to change a direction and a flow rate of hydraulic oil supplied to the arm cylinder 8. A bucket control valve is interposed between one of the first and second hydraulic pumps and the bucket cylinder 9, and performs opening and closing operation to change a direction and a flow rate of hydraulic oil supplied to the bucket cylinder 9. A slewing control valve is interposed between one of the first and second hydraulic pumps and the slewing motor 11, and performs opening and closing operation to change a direction and a flow rate of hydraulic oil supplied to the slewing motor 11.

A plurality of manipulation devices include a boom manipulation device 27 (see FIG. 2) that receives manipulation for operating the boom 4, an arm manipulation device (not illustrated) that receives manipulation for operating the arm 5, a bucket manipulation device (not illustrated) that receives manipulation for operating the bucket 6, and a slewing manipulation device (not illustrated) for slewing the upper slewing body 2 with respect to the lower travelling body 1. Each of the plurality of manipulation devices has a manipulation lever that can be manipulated by an operator. Each of a plurality of manipulation devices is an electric lever device that outputs a command signal (electric signal) corresponding to a direction of manipulation given by an operator to the manipulation lever and a manipulation amount of the manipulation. The output command signal is input to the work machine controller 50.

Specifically, the boom manipulation device 27 is configured to be capable of receiving boom raising manipulation for causing the boom 4 to perform boom raising operation and boom lowering manipulation for causing the boom 4 to perform boom lowering operation. The boom raising operation is operation of the boom 4 in which a tip portion of the boom 4 moves away from the ground, and the boom lowering operation is operation of the boom 4 in which the tip portion of the boom 4 approaches the ground. Upon receiving the boom raising manipulation, the boom manipulation device 27 inputs a boom raising command signal corresponding to a manipulation amount of the boom raising manipulation to the work machine controller 50. Upon receiving the boom lowering manipulation, the boom manipulation device 27 inputs a boom lowering command signal corresponding to a manipulation amount of the boom lowering manipulation to the work machine controller 50. Since a basic configuration and function of each of the arm manipulation device, the bucket manipulation device, and the slewing manipulation device are similar to those of the boom manipulation device 27, detailed description of them will be omitted.

Each of a plurality of proportional valves decompresses and outputs pressure oil of the pilot pump 22 in accordance with a control command input from the work machine controller 50. Each of a plurality of proportional valves is configured by, for example, an electromagnetic proportional valve. A plurality of proportional valves include a pair of boom proportional valves 24 and 25, a pair of arm proportional valves (not illustrated), a pair of bucket proportional valves (not illustrated), and a pair of slewing proportional valves (not illustrated).

Specifically, each of a pair of the boom proportional valves 24 and 25 decompresses pressure oil from the pilot pump 22 in accordance with a control command (command current) input from the work machine controller 50, and outputs pilot pressure corresponding to the control command to the boom control valve 23. The boom proportional valve 24 is arranged on a pilot line connecting the pilot pump 22 and one pilot port of the boom control valve 23, and the boom proportional valve 25 is arranged on a pilot line connecting the pilot pump 22 and the other pilot port of the boom control valve 23.

When the boom manipulation device 27 receives the boom lowering manipulation, a control command from the work machine controller 50 is input to the boom proportional valve 24. The boom proportional valve 24 generates pilot pressure according to the control command, and the generated pilot pressure is supplied to one pilot port (a port on the left side of the boom control valve 23 in FIG. 2) of the boom control valve 23. A spool of the boom control valve 23 is shifted by a displacement amount (shift amount from a neutral position) corresponding to the supplied pilot pressure. By the above, the boom control valve 23 is adjusted to an opening degree (opening amount) corresponding to the displacement amount, allows hydraulic oil discharged from the hydraulic pump 21 to be supplied to the rod chamber 7R of the boom cylinder 7 at a flow rate corresponding to the displacement amount, and allows hydraulic oil to be discharged from the head chamber 7H and returned to a tank.

When the boom manipulation device 27 receives boom raising manipulation, a control command from the work machine controller 50 is input to the boom proportional valve 25. The boom proportional valve 25 generates pilot pressure according to the control command, and the generated pilot pressure is supplied to the other pilot port (a port on the right side of the boom control valve 23 in FIG. 2) of the boom control valve 23. A spool of the boom control valve 23 is shifted by a displacement amount (shift amount from a neutral position) corresponding to the supplied pilot pressure. By the above, the boom control valve 23 is adjusted to an opening degree (opening amount) corresponding to the displacement amount, allows hydraulic oil discharged from the hydraulic pump 21 to be supplied to the head chamber 7H of the boom cylinder 7 at a flow rate corresponding to the displacement amount, and allows hydraulic oil to be discharged from the rod chamber 7R and returned to a tank.

Each of a pair of the arm proportional valves decompresses pressure oil from the pilot pump 22 in accordance with a control command input from the work machine controller 50, and outputs pilot pressure corresponding to the control command to the arm control valve. Each of a pair of the bucket proportional valves decompresses pressure oil from the pilot pump 22 in accordance with a control command input from the work machine controller 50, and outputs pilot pressure corresponding to the control command to the bucket control valve. Each of a pair of the slewing proportional valves decompresses pressure oil from the pilot pump 22 in accordance with a control command input from the work machine controller 50, and outputs pilot pressure corresponding to the control command to the slewing control valve. A basic configuration and a function of these proportional valves are similar to those of the boom proportional valves 24 and 25, and omitted from detailed description.

The work machine 100 includes at least one object to be controlled. The at least one object to be controlled may include, for example, an object to be controlled related to derricking operation of the boom 4, an object to be controlled related to rotation operation of the arm 5, an object to be controlled related to rotation operation of the bucket 6, and an object to be controlled related to slewing operation of the upper slewing body 2. In this case, each of these objects to be controlled may include, for example, a pair of proportional valves, a control valve, a hydraulic actuator, and a movable portion. Specifically, the object to be controlled related to derricking operation of the boom 4 may include a pair of the boom proportional valves 24 and 25, the boom control valve 23, the boom cylinder 7, and the boom 4 (an example of a movable portion). The object to be controlled related to rotation operation of the arm 5 may include the pair of arm proportional valves, the arm control valve, the arm cylinder 8, and the arm 5 (an example of a movable portion). The object to be controlled related to rotation operation of the bucket 6 may include the pair of bucket proportional valves, the bucket control valve, the bucket cylinder 9, and the bucket 6 (an example of a movable portion). The object to be controlled related to slewing operation of the upper slewing body 2 may include the pair of slewing proportional valves, the slewing control valve, the slewing motor 11, and the upper slewing body 2 (an example of a movable portion). However, the object to be controlled in the present disclosure is not limited to the above specific example.

Each of a plurality of detectors detects information necessary for enabling the work machine controller 50 to control operation of the work machine 100, and inputs a detection signal, which is an electric signal corresponding to the information, to the work machine controller 50. A plurality of detectors include a boom related operation detector 31 that is a detector that detects output of an object to be controlled related to derricking operation of the boom 4, an arm related operation detector 32 that is a detector that detects output of an object to be controlled related to rotation operation of the arm 5, a bucket related operation detector 33 that is a detector that detects output of an object to be controlled related to rotation operation of the bucket 6, and a slewing related operation detector 34 that is a detector that detects output of an object to be controlled related to slewing operation of the upper slewing body 2.

The boom related operation detector 31 may be, for example, a boom angle sensor, a stroke sensor that detects operation of the boom cylinder 7, or another sensor. The boom angle sensor is a sensor that detects an angle of the boom 4 with respect to the upper slewing body 2. Examples of such an angle sensor include a resolver, a rotary encoder, a potentiometer, and an inertial measurement unit (IMU). The stroke sensor may be one that detects a cylinder length of a hydraulic cylinder or one that detects a position of a piston rod with respect to a cylinder tube.

Similarly, the arm related operation detector 32 may be an arm angle sensor that detects an angle of the arm 5 with respect to the boom 4, may be a stroke sensor that detects operation of the arm cylinder 8, or may be another sensor. The bucket related operation detector 33 may be a bucket angle sensor that detects an angle of the bucket 6 with respect to the arm 5, may be a stroke sensor that detects operation of the bucket cylinder 9, or may be another sensor. The slewing related operation detector 34 may be, for example, a slewing angle sensor that detects an angle of the upper slewing body 2 with respect to the lower travelling body 1, a gyro sensor that detects an angular velocity (slewing angular velocity) of the upper slewing body 2 with respect to the lower travelling body 1, or another sensor.

The work machine controller 50 can acquire control output information, which is information related to output of an object to be controlled, based on a detection signal input from a plurality of detectors. The work machine controller 50 can calculate an operation speed of a movable portion based on control output information, for example. Further, the work machine controller 50 can calculate, for example, a posture of a movable portion on the basis of control output information. Operation speed of a movable portion may be, for example, operation speed of the boom 4 with respect to the upper slewing body 2, operation speed of the arm 5 with respect to the boom 4, operation speed of the bucket 6 with respect to the arm 5, or operation speed of the upper slewing body 2 with respect to the lower travelling body 1. Posture of a movable portion may be, for example, posture of the boom 4 with respect to the upper slewing body 2, posture of the arm 5 with respect to the boom 4, posture of the bucket 6 with respect to the arm 5, or posture of the upper slewing body 2 with respect to the lower travelling body 1.

The work machine controller 50 includes an arithmetic processing device such as a CPU and a memory. As illustrated in FIG. 2, the work machine controller 50 includes a manipulation ability determination part 51, a work content determination part 52, a target setting part 53, a parameter setting part 54, an assist amount calculation part 55, a control command calculation part 56, a work machine storage part 57, and a work machine communication part 58. Each of the manipulation ability determination part 51, the work content determination part 52, the target setting part 53, the parameter setting part 54, the assist amount calculation part 55, the control command calculation part 56, the work machine storage part 57, and the work machine communication part 58 is realized by an arithmetic processing device of the work machine controller 50 executing a control program.

The management device 60 includes the management device controller 67, and the management device controller 67 includes an arithmetic processing device such as a CPU and a memory. As illustrated in FIG. 2, the management device controller 67 of the management device 60 includes a management device communication part 61, a data group storage part 62, and a data group setting part 63. Each of the management device communication part 61, the data group storage part 62, and the data group setting part 63 is realized by an arithmetic processing device of the management device controller 67 executing a control program.

The work machine communication part 58 and the management device communication part 61 are configured to be able to perform bidirectional communication (for example, wireless communication) of data between the work machine controller 50 of the work machine 100 and the management device 60. In the present embodiment, each of the work machine communication part 58 and the management device communication part 61 includes a communication antenna capable of bidirectional wireless communication of data between the work machine controller 50 and the management device 60.

As illustrated in FIG. 5, the data group storage part 62 of the management device 60 stores in advance a plurality of data groups including data groups A, B, C, D, E, and F related to a plurality of pieces of past work which are a plurality of pieces of works in the past by a plurality of work machines. Each of a plurality of data groups includes work content past data, manipulation ability past data, at least one piece of control parameter past data, and operator past data. These pieces of past data are associated with each other and stored in the data group storage part 62 as one data set (data group).

In the present embodiment, an operator operating the work machine 100 is an operator OPc as illustrated in FIG. 6. As illustrated in FIG. 5, a plurality of data groups include data groups related to an operator OPa and an operator OPb different from the operator OPc.

The work content past data is data related to work content in the past work. The work content past data is data indicating a determination result of work content determined by the work content determination part 52 in the past work, and is denoted as "work content determination result" in FIG. 5. As illustrated in FIG. 5, as work content, excavating and loading work, flat ground leveling work, and slope surface leveling work can be exemplified, but the work content is not limited to these specific examples. For example, work content may be suspended load carrying work.

The manipulation ability past data is data related to manipulation ability of an operator in the past work. The manipulation ability past data is data indicating a determination result of manipulation ability determined by the manipulation ability determination part 51 in the past work, and is denoted as "manipulation ability determination result" in FIG. 5.

The at least one piece of control parameter past data is data related to a control parameter associated with the manipulation ability past data. The at least one piece of control parameter past data may include, for example, past data (at least one piece of design parameter past data) related to at least one design parameter used for feedback control and past data (at least one piece of target value corresponding past data) corresponding to at least one target value used for feedback control. The at least one piece of design parameter past data is, for example, past data related to a gain corresponding to a type of feedback control among a proportional gain (Kp), an integral gain (Ki), and a derivative gain (Kd). The at least one piece of target value corresponding past data may include, for example, at least one of speed past data, acceleration past data, torque past data, and position past data (posture past data). The speed past data is past data related to speed of operation of a movable portion in past work. The acceleration past data is past data related to acceleration of operation of a movable portion in past work. The torque past data is past data related to torque of the slewing motor 11 in slewing operation of the upper slewing body 2 in past work. The position past data (posture past data) is past data related to a position (posture) of a movable portion in past work.

The operator past data is data related to an operator associated with the manipulation ability past data. The operator past data may include identification information for identifying an operator who performs past work.

In the specific example illustrated in FIG. 3, the management device controller 67 of the management device 60 further includes an operation information storage part 64 and a past data group construction part 65. As illustrated in FIG. 3, for example, in past work A, which is past work by a work machine A, when the past work A is completed, operation information A related to the past work A is transmitted from the work machine A to the management device 60. The operation information A includes information on work content of the past work A, information on manipulation ability of an operator of the past work A, information on a control parameter set in the past work A, and information on an operator of the past work A. The operation information storage part 64 of the management device 60 stores the operation information A, the past data group construction part 65 constructs, as one data group A, work content past data which is past data related to work content in the past work A, manipulation ability past data which is past data related to manipulation ability in the past work A, control parameter past data which is past data related to a control parameter in the past work A, and operator past data which is past data related to an operator in the past work A in association with each other based on the operation information A, and the data group storage part 62 stores the data group A. Similarly, in past work B, which is past work by a work machine B, when the past work B is completed, operation information B related to the past work B is transmitted from the work machine B to the management device 60. The operation information storage part 64 of the management device 60 stores the operation information B, the past data group construction part 65 constructs one data group B by associating work content past data, manipulation ability past data, control parameter past data, and operator past data with each other based on the operation information B, and the data group storage part 62 stores the data group B.

Note that each of the operation information A and B transmitted from the work machines A and B to the management device 60 may further include, for example, at least one of speed information, acceleration information, position information (posture information), work load information, and manipulation amount information. The speed information is information on speed of operation of a movable portion in each of the past work A and B. The acceleration information is information on acceleration of operation of a movable portion in each of the past work A and B. The position information (posture information) is information on a position of a movable portion (posture of a movable portion) in the past work A and B. The work load information is information on a work load (for example, a weight of a suspended load) in the past work A and B. The manipulation amount information is information on a manipulation amount given to a manipulation device in each of the past work A and B. Each of the data groups A and B constructed by the past data group construction part 65 may include at least one of speed past data which is past data related to speed of the operation, acceleration past data which is past data related to acceleration of the operation, position past data (posture past data) which is past data related to the position (posture), work load past data which is past data related to the work load, and manipulation amount past data which is past data related to the manipulation amount.

As illustrated in FIG. 3, the data group setting part 63 sets a target data group X, which is a data group suitable for current operation information of the work machine 100, by using the plurality of data groups. The target data group X includes information on a control parameter. Setting of the target data group X will be described later.

Next, the work machine controller 50 of the work machine 100 will be described.

The manipulation ability determination part 51 determines manipulation ability that is ability of manipulation of an operator manipulating the work machine 100. A specific example of a method of determining manipulation ability will be described below. However, the method of determining manipulation ability is not limited to a specific example below, and various methods can be employed.

The manipulation ability determination part 51 can identify a start time point and an end time point of work content based on determination of the work content by the work content determination part 52 described later. In a case where work content is, for example, excavation and loading work, the manipulation ability determination part 51 can calculate work efficiency, which is efficiency of excavation and loading work, on the basis of elapsed time from a start time point to an end time point of work and a weight of earth and sand loaded on a cargo bed of a carrier such as a truck from the start time point to the end time point of the work, and determine manipulation ability of an operator on the basis of the calculated work efficiency and evaluation criteria such as a preset map and a calculation formula. In the specific examples of FIGS. 5 and 6, the manipulation ability determination part 51 determines which level in a range from 0 to 100 points manipulation ability of an operator corresponds to, but is not limited to such a specific example.

The work content determination part 52 determines work content which is content of work by the work machine 100. As illustrated in FIG. 5, as work content, excavating and loading work, flat ground leveling work, and slope surface leveling work can be exemplified, but the work content is not limited to these specific examples. The work content may be, for example, suspended load carrying work as described above.

The work content determination part 52 can acquire posture (specifically, posture of the boom 4, posture of the arm 5, posture of the bucket 6, and posture of the upper slewing body 2) of a plurality of movable portions based on a detection signal input from the plurality of detectors 31 to 34 to the work machine controller 50. For example, in each of excavation and loading work, flat ground leveling work, and slope surface leveling work, posture of a plurality of movable portions characteristically changes, so that the work content determination part 52 can determine work content of the work machine 100 based on posture data of a plurality of movable portions. Specifically, for example, in a case where each posture of a plurality of movable portions satisfies a condition related to predetermined excavation posture and satisfies a condition related to predetermined loading posture, the work content determination part 52 determines that the work machine 100 is performing excavating and loading work. Similarly, in a case where each posture of a plurality of movable portions satisfies a condition related to predetermined flat ground leveling posture, the work content determination part 52 determines that the work machine 100 is performing flat ground leveling work. In a case where each posture of a plurality of movable portions satisfies a condition related to predetermined slope surface leveling posture, the work content determination part 52 determines that the work machine 100 is performing slope surface leveling work. In a case where each posture of a plurality of movable portions satisfies a condition related to predetermined suspended load carrying posture, the work content determination part 52 determines that the work machine 100 is performing suspended load carrying work. Each posture of a plurality of movable portions may be indicated by, for example, coordinates in a coordinate system with a preset reference point in the work machine 100 as an origin, or may be indicated by a boom angle, an arm angle, a bucket angle, and a slewing angle.

The work content determination part 52 may determine work content by the work machine 100 based on a load applied to the work device 3 instead of posture data of a plurality of movable portions as described above. In this case, the work content determination part 52 may determine work content by the work machine 100 based on, for example, a detection result (detection signal) of a load sensor attached to the work device 3.

The target setting part 53 sets target manipulation ability related to a target of manipulation ability of an operator in association with manipulation ability.

The target input device 41 is a device that allows an operator or a work related person related to work by an operator to input a target of manipulation ability. The work related person may include, for example, a manager of work by the work machine 100, a supervisor of a work site, an assistant of work by the work machine 100, and the like. In this case, the target setting part 53 may set the target manipulation ability by using a target of the manipulation ability input to the target input device 41 by an operator or a work related person and the manipulation ability (current manipulation ability), and the parameter setting part 54 may set a control parameter corresponding to the target manipulation ability set in association with manipulation ability by using the operation information and the plurality of data groups.

The parameter setting part 54 may set a control parameter according to current manipulation ability by using operation information and a plurality of data groups. Further, the parameter setting part 54 may set a control parameter according to current manipulation ability and the work content by using the operation information and the plurality of data groups. In the present embodiment, as illustrated in FIG. 6, operation information includes information on an operator, information on work content, information on manipulation ability, and information on target manipulation ability. Therefore, the parameter setting part 54 may set a control parameter according to the target manipulation ability set in association with manipulation ability by using the operation information and the plurality of data groups, and may set a control parameter according to the target manipulation ability and the work content by using the operation information and the plurality of data groups.

Specifically, for example, the parameter setting part 54 may be configured to set at least one control parameter by using at least one data group selected from a plurality of data groups according to current operation information. By the above, the parameter setting part 54 can set a control parameter corresponding to current manipulation ability included in current operation information or a control parameter corresponding to target manipulation ability included in current operation information.

More specifically, for example, the parameter setting part 54 may set, as a control parameter, control parameter past data included in any one data group (target data group X) selected from a plurality of data groups by using operation information and a plurality of data groups as described later. In this case, the data group setting part 63 to be described later may select a data group including manipulation ability past data suitable for current manipulation ability included in current operation information or manipulation ability past data suitable for target manipulation ability included in current operation information from a plurality of data groups and set the selected data group as the target data group X. Then, the parameter setting part 54 may set control parameter past data included in the selected target data group X as a control parameter. By the above, the parameter setting part 54 can set a control parameter corresponding to manipulation ability included in current operation information or a control parameter corresponding to target manipulation ability included in current operation information.

Further, as described later, the parameter setting part 54 may set, as a control parameter, data (reconstructed control parameter past data) included in the target data group X reconstructed using operation information and a plurality of data groups. In this case, the data group setting part 63 to be described later may select two or more data groups including manipulation ability past data suitable for current manipulation ability included in current operation information or manipulation ability past data suitable for target manipulation ability included in current operation information from a plurality of data groups. Then, the data group setting part 63 may reconstruct (set) the target data group X by using the selected two or more data groups. The reconstructed target data group X includes the reconstructed control parameter past data. The reconstructed control parameter past data may be, for example, an average value of control parameter past data included in the two or more data groups. Further, the reconstructed control parameter past data may be calculated using, for example, control parameter past data included in the two or more data groups and a linear interpolation method. Then, the parameter setting part 54 may set reconstructed control parameter past data included in the reconstructed target data group X as a control parameter. By the above, the parameter setting part 54 can set a control parameter corresponding to manipulation ability included in current operation information or a control parameter corresponding to target manipulation ability included in current operation information.

The at least one control parameter may include at least one design parameter used for feedback control. In a case where the feedback control is P control, the at least one design parameter includes a proportional gain (Kp). In a case where the feedback control is PI control, the at least one design parameter includes a proportional gain (Kp) and an integral gain (Ki). Further, in a case where the feedback control is PID control, the at least one setting parameter includes a proportional gain (Kp), an integral gain (Ki), and a derivative gain (Kd).

Further, the at least one control parameter may include at least one target value used for feedback control. The at least one target value may include at least one of a target speed, a target acceleration, and a target position.

The assist amount calculation part 55 calculates an assist amount for assisting manipulation by an operator by using the at least one control parameter set by the parameter setting part 54.

The control command calculation part 56 calculates a control command for operating the object to be controlled by using a manipulation amount of the manipulation given to the manipulation device and the assist amount, and inputs the control command to the object to be controlled. In the present embodiment, for example, the control command calculation part 56 calculates a control command for operating an object to be controlled related to derricking operation of the boom 4 by using a manipulation amount of the manipulation given to the boom manipulation device 27 and the assist amount, and inputs the control command to one of a pair of the boom proportional valves 24 and 25 included in the object to be controlled.

The work machine controller 50 including the work machine storage part 57 and the work machine communication part 58 is mounted on the work machine 100, and the work machine storage part 57 stores the operation information. In the present embodiment, the work machine storage part 57 temporarily stores the operation information.

The work machine communication part 58 transmits the operation information stored in the work machine storage part 57 to the management device communication part 61 of the management device 60 when work by the work machine 100 is finished or interrupted. When the operation information is transmitted to the management device 60, the work machine storage part 57 may erase the operation information. The work machine controller 50 may be configured to determine that work by the work machine 100 is finished or interrupted when a preset condition by which work by the work machine 100 can be determined to be finished or interrupted is satisfied. Further, in a case where work by the work machine 100 is finished or interrupted, an operator may perform work stop input, which is predetermined input, on an input device (not illustrated), so that a signal corresponding to the work stop input is configured to be input from the input device to the work machine controller 50.

The display 42 displays manipulation ability on the basis of a determination result of the manipulation ability by the manipulation ability determination part 51. The display 42 may include, for example, a display arranged in a cabin of the work machine 100. In the present embodiment, the display 42 may be configured to display, for example, work content (work content determination result), manipulation ability (manipulation ability determination result), and target manipulation ability included in operation information as illustrated in FIG. 6.

Assist control performed by the work machine controller 50 may include, for example, at least one of responsiveness assist control, speed assist control, acceleration assist control, torque assist control, and posture assist control. Specifically, these will be described as described below.

The responsiveness assist control is assist control related to responsiveness of operation of a movable portion. The responsiveness assist control assists manipulation by an operator, for example, by adjusting responsiveness of operation of a movable portion to manipulation by an operator given to a manipulation device to a level corresponding to manipulation ability of the operator. Specifically, responsiveness of operation of a movable portion may be set higher as manipulation ability of an operator is higher, for example. Responsiveness of manipulation of a movable portion may be adjusted based on, for example, the at least one design parameter. Therefore, in a case where the work machine controller 50 is configured to perform the responsiveness assist control, the at least one control parameter includes the at least one design parameter, and the at least one design parameter includes at least one of a proportional gain, an integral gain, and a derivative gain. The at least one piece of control parameter past data includes at least one piece of past data (the at least one piece of design parameter past data) corresponding to the at least one design parameter.

The speed assist control is assist control related to speed of operation of a movable portion. The speed assist control assists manipulation by an operator, for example, by adjusting speed of operation of a movable portion to a magnitude corresponding to manipulation ability of the operator. Specifically, a target speed (for example, an upper limit speed) of operation of a movable portion may be set to be higher as manipulation ability of an operator is higher, for example. In a case where the work machine controller 50 is configured to perform the speed assist control, the at least one control parameter includes a target speed (an example of the target value), and the at least one piece of control parameter past data includes the speed past data which is past data corresponding to the target speed.

The acceleration assist control is assist control related to acceleration of operation of a movable portion. The acceleration assist control assists manipulation by an operator, for example, by adjusting an acceleration of operation of a movable portion to a magnitude corresponding to manipulation ability of the operator. Specifically, in a case where an acceleration is a positive value, a target acceleration (for example, an upper limit acceleration) of operation of a movable portion may be set to be larger as manipulation ability of an operator is higher, for example. In a case where a braking force is applied to operation of a movable portion (in a case where an acceleration is negative), a target acceleration of operation of a movable portion may be set smaller as manipulation ability of an operator is higher, for example. In a case where the work machine controller 50 is configured to perform the acceleration assist control, the at least one control parameter includes a target acceleration (an example of the target value), and the at least one piece of control parameter past data includes the acceleration past data which is past data corresponding to the target acceleration.

The torque assist control is assist control related to torque in slewing operation of the upper slewing body 2 with respect to the lower travelling body 1. The torque assist control assists manipulation by an operator, for example, by adjusting torque generated by the slewing motor 11 for slewing operation of the upper slewing body 2 to a magnitude corresponding to manipulation ability of the operator. Specifically, a target torque (for example, an upper limit torque) of slewing operation may be set larger as manipulation ability of an operator is higher, for example. In a case where the work machine controller 50 is configured to perform the torque assist control, the at least one control parameter includes a target torque (an example of the target value), and the at least one piece of control parameter past data includes the torque past data which is past data corresponding to the target torque.

The posture assist control is assist control related to posture of a movable portion. The posture assist control assists manipulation by an operator, for example, by adjusting posture of a movable portion to posture according to manipulation ability of the operator. In a case where the work machine controller 50 is configured to perform the posture assist control, the at least one control parameter includes a target position (an example of the target value), and the at least one piece of control parameter past data includes the position past data (the posture past data) which is past data corresponding to the target position.

Figure 7:
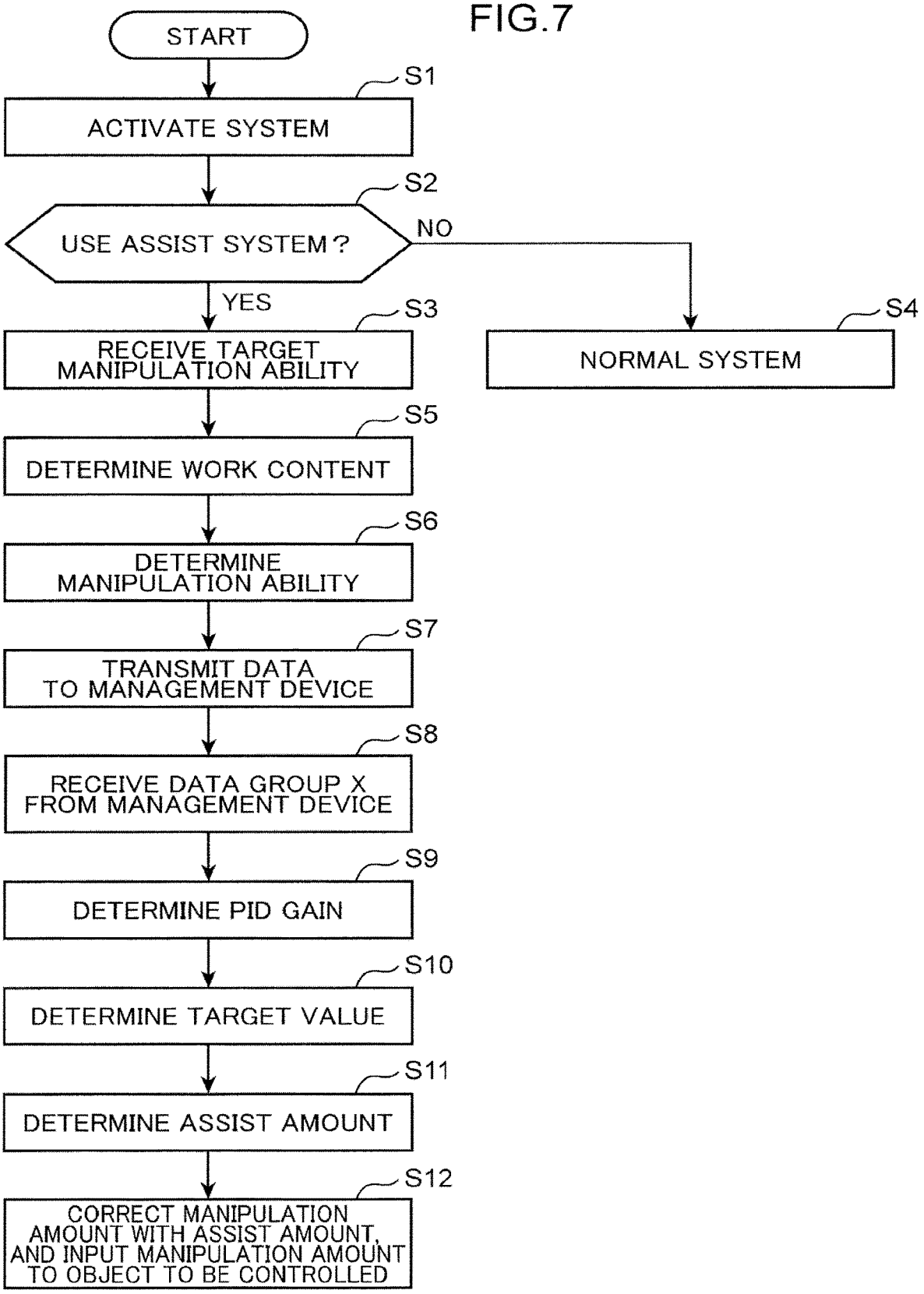
FIG. 7 is a flowchart illustrating an example of arithmetic processing by the work machine controller.

Hereinafter, an example of arithmetic processing by the work machine controller 50 will be described with reference to a flowchart illustrated in FIG. 7.

When an operator of the work machine 100 gives manipulation for activating a system of the work machine 100 to the work machine 100, the system is activated (Step S1).

For example, on the display 42, the work machine controller 50 performs display for prompting an operator to input whether or not to use the work machine control system (assist system) according to the present embodiment (Step S2). When an operator performs input to the display 42 to use the assist system (YES in Step S2), the work machine controller 50 executes processing in and after Step S3. When an operator performs input to the display 42 not to use the assist system (NO in Step S2), the work machine controller 50 executes a normal system instead of the assist system (Step S4).

Next, the work machine controller 50 receives input related to target manipulation ability in the target input device 41 (Step S3). An operator or a work related person inputs an increase range (target increase range) of manipulation ability to the target input device 41 as a target of manipulation ability. The input target increase range is input to the work machine controller 50.

Next, when work by an operator using the work machine 100 is started, the work content determination part 52 determines work content which is content of work by the work machine 100, for example, by the above-described method (Step S5).

Further, the manipulation ability determination part 51 determines manipulation ability that is current ability of manipulation of an operator, for example, by the method as described above (Step S6).

Next, as illustrated in FIG. 6, for example, the work machine controller 50 generates operation information which is a set of data in which information on the operator OPc, information on a determination result of work content, information on a determination result of manipulation ability, and information on target manipulation ability are associated with each other. As described above, the operation information may further include at least one of speed information, acceleration information, position information (posture information), work load information, and manipulation amount information. Then, the work machine controller 50 (work machine communication part 58) transmits the operation information to the management device 60 (Step S7). Note that, in the present embodiment, the target setting part 53 of the work machine controller 50 calculates target manipulation ability by adding a target increase range input from the target input device 41 to manipulation ability determined by the manipulation ability determination part 51. Information on target manipulation ability in the operation information includes data of the calculated target manipulation ability. The target manipulation ability is set based on a target increase range input by an operator as described above. Then, as will be described later, a control parameter is set on the basis of the target manipulation ability. Therefore, this assist control can promote improvement in ability of an operator if the operator does not grasp his or her own manipulation ability. Note that the target manipulation ability only needs to be associated with determined manipulation ability, and thus a method of calculating target manipulation ability is not limited to the above specific example. For example, in a case where an increase rate (target increase rate) of manipulation ability is input to the target input device 41 as a target of manipulation ability, the target setting part 53 may calculate target manipulation ability by multiplying manipulation ability by the input target increase rate.

When the management device 60 (management device communication part 61) receives the data set (current operation information), as illustrated in FIG. 3, the data group setting part 63 sets the target data group X, which is a data group suitable for the operation information of the work machine 100, by using a plurality of data groups stored in the data group storage part 62. Specifically, for example, the data group setting part 63 may set or reconstruct the target data group X as described below on the basis of a comparison result between current operation information and the plurality of data groups.

That is, the data group setting part 63 may select one data group suitable for current operation information and set the selected one data group as the target data group X. Further, the data group setting part 63 may select two or more data groups suitable for the operation information, and newly set the target data group X by using the selected two or more data groups. In the present disclosure, the data group setting part 63 selecting two or more data groups suitable for the operation information and newly setting the target data group X by using the selected two or more data groups is referred to as reconstruction of the target data group X.

More specifically, for example, the data group setting part 63 may compare information on a determination result of work content and information on a determination result of manipulation ability included in current operation information with the plurality of data groups, select one data group including work content past data corresponding to the work content and including manipulation ability past data suitable for current work ability (preferably, manipulation ability past data matching the manipulation ability) from the plurality of data groups, and set the selected one data group as the target data group X.

Further, the data group setting part 63 may compare information on a determination result of work content and information on target manipulation ability included in current operation information with the plurality of data groups, select one data group including work content past data corresponding to the work content and including manipulation ability past data suitable for target work ability (preferably, manipulation ability past data matching the target manipulation ability) from the plurality of data groups, and set the selected one data group as the target data group X.

Note that the data group setting part 63 may select the one data group as described below, for example. That is, the data group setting part 63 may select one data group including manipulation ability past data closest to manipulation ability or target manipulation ability included in current operation information and including the work content past data corresponding to the work content from a plurality of data groups. The control parameter past data included in the selected one data group is set as a control parameter by the parameter setting part 54 as described later.

Further, the data group setting part 63 may newly set (reconstruct) the target data group X as described below instead of setting one data group included in a plurality of data groups as the target data group X as described above.

That is, the data group setting part 63 may compare information on a determination result of work content and information on a determination result of manipulation ability included in current operation information with the plurality of data groups, select two or more data groups (for example, two data groups) suitable for current operation information from the plurality of data groups, and newly set (reconstruct) the target data group X by using the selected two or more data groups.

Further, the data group setting part 63 may compare information on a determination result of work content and information on target manipulation ability included in current operation information with the plurality of data groups, select two or more data groups (for example, two data groups) suitable for current operation information from the plurality of data groups, and newly set (reconstruct) the target data group X by using the selected two or more data groups.

Two or more data groups selected by the data group setting part 63 include a first data group and a second data group. Each of the selected two or more data groups includes the work content past data corresponding to the work content and includes manipulation ability past data suitable for the manipulation ability or target manipulation ability. Note that the data group setting part 63 may select the two or more data groups as described below, for example. That is, the data group setting part 63 may select, as a first data group, a data group including manipulation ability past data closest to manipulation ability or target manipulation ability and including the work content past data corresponding to the work content from a plurality of data groups. Further, the data group setting part 63 may select, as a second data group, a data group including manipulation ability past data second closest to manipulation ability or target manipulation ability and including the work content past data corresponding to the work content from a plurality of data groups.

Then, the data group setting part 63 may newly set (reconstruct) control parameter past data by using the control parameter past data included in the selected two or more data groups. That is, the reconstructed target data group X includes reconstructed control parameter past data.

Control parameter past data in the target data group X may be reconstructed as described below, for example. That is, the data group setting part 63 may set, as control parameter past data in the target data group X, a value calculated by using control parameter past data included in the selected two or more data groups and, for example, a linear interpolation method. Further, the data group setting part 63 may calculate an average value of control parameter past data included in the selected two or more data groups and set the average value as control parameter past data in the target data group X. However, a method of reconstructing control parameter past data in the target data group X is not limited to linear interpolation and calculation of the average value as described above.

In the present embodiment, in a case where assist control by the work machine controller 50 includes the responsiveness assist control, the control parameter past data in the target data group X may include the at least one design parameter (at least one of a proportional gain, an integral gain, and a derivative gain). In this case, control parameter past data included in each of a plurality of data groups may include past data (the design parameter past data) corresponding to the at least one design parameter. Further, in the present embodiment, in a case where assist control by the work machine controller 50 further includes the speed assist control, the control parameter past data in the target data group X may further include the target speed. In this case, control parameter past data included in each of a plurality of data groups may further include the speed past data.

In the present embodiment, each of the two or more past data groups selected by the data group setting part 63 includes speed past data as control parameter past data. For example, the data group setting part 63 may calculate an average value of speed past data included in the two or more data groups and set the average value as control parameter past data in the target data group X, that is, the target value corresponding past data.

Note that, in a case where assist control by the work machine controller 50 includes the acceleration assist control, the control parameter past data in the target data group X may include the target acceleration. In this case, control parameter past data included in each of a plurality of data groups may include the acceleration past data. Further, in a case where assist control by the work machine controller 50 includes the torque assist control, the control parameter past data in the target data group X may include the target torque. In this case, control parameter past data included in each of a plurality of data groups may include the torque past data. In a case where assist control by the work machine controller 50 includes the posture assist control, the control parameter past data in the target data group X may include the target position (the target posture). In this case, control parameter past data included in each of a plurality of data groups may include the position past data (the posture past data).

The management device 60 (management device communication part 61) transmits information on the set target data group X to the work machine controller 50 of the work machine 100, and the work machine controller 50 (work machine communication part 58) receives information on the target data group X (Step S8).

In the present embodiment, at least one piece of control parameter past data included in the received target data group X includes, for example, information on at least one design parameter (PID gain: Kp, Ki, Kd) used for feedback control (PID control) and information on a target speed (an example of a target value). Information on a target speed (target value) is the target value corresponding past data.

Figure 4:
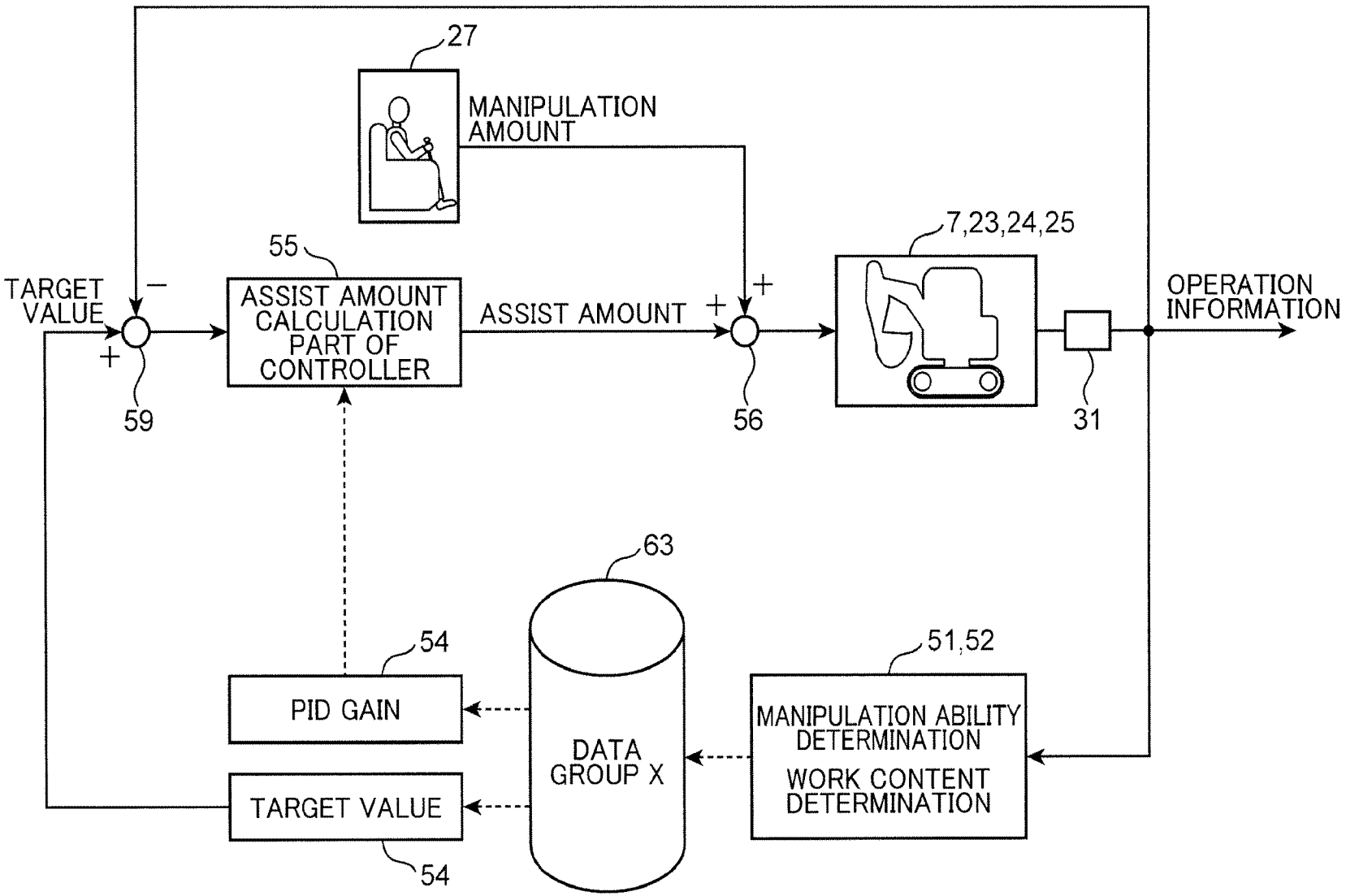
FIG. 4 is a block diagram illustrating a process of control by a controller of the work machine control system.

The parameter setting part 54 of the work machine controller 50 sets a PID gain for feedback control (PID control) illustrated in the block diagram of FIG. 4 as a control parameter based on information on the at least one design parameter included in the target data group X (Step S9). That is, the parameter setting part 54 sets a value of the at least one design parameter included in the target data group X to a PID gain as a control parameter.

Further, the parameter setting part 54 sets a target value (target speed) for feedback control illustrated in the block diagram of FIG. 4 as a control parameter on the basis of information on a target speed included in the target data group X, that is, the target value corresponding past data (Step S10). In other words, the parameter setting part 54 sets a value of target value corresponding past data included in the target data group X as a target value as a control parameter. As the speed assist control based on a target speed is performed, a speed of operation of a movable portion is controlled to approach the target speed. Note that an upper limit speed of operation of a movable portion may be set to a target speed. In the present embodiment, this target speed may be set higher as manipulation ability of an operator is higher.

Next, as illustrated in FIG. 4, a subtractor 59 of the work machine controller 50 calculates an error between the target value and control output that is output from an object to be controlled. The assist amount calculation part 55 substitutes a PID gain set by the parameter setting part 54 and the error into Equation (1) below to calculate an assist amount for bringing the error close to zero (S11). In Equation (1) below, "u" is an assist amount, "Kp", "Ki", and "Kd" are PID gains (a proportional gain, an integral gain, and a derivative gain), and "e" is an error between a control output and a target value. In the present embodiment, control output used for calculation of an error is an actual operation speed of a movable portion (for example, the boom 4), and is detected by a detector such as the boom related operation detector 31, for example. The target value is a target speed.

[Equation 1]

$$u(t) = K_p e(t) + K_i \int_0^t e(\tau)\, d\tau + K_d \frac{de(t)}{dt} \tag{1}$$

Next, the control command calculation part 56 calculates a control command for operating the object to be controlled by using, for example, a manipulation amount of the manipulation given to the boom manipulation device 27 and the assist amount, and inputs the control command to one of a pair of the boom proportional valves 24 and 25 (a boom proportional valve corresponding to a manipulation direction of the manipulation) included in the object to be controlled (Step S12). That is, the control command calculation part 56 calculates a control command in which a manipulation amount of the manipulation is corrected using the assist amount, and inputs the control command to one of a pair of the boom proportional valves 24 and 25. Specifically, for example, the control command may be a value obtained by adding the assist amount to a manipulation amount of the manipulation. The work machine controller 50 repeats the control of Steps S5 to S12.

Note that the same value as the value initially set in Step S9 may be used as a PID gain as a control parameter set by the parameter setting part 54 while one piece of work is performed, may be updated a plurality of times based on a preset condition while one piece of work is performed, or may be updated in every cycle of Steps S5 to S12.

As described above, in the work machine control system according to the present embodiment, the manipulation ability determination part 51 determines manipulation ability, which is ability of manipulation of an operator, for each piece of work by the work machine 100, and the parameter setting part 54 sets a control parameter according to manipulation ability by using operation information including the manipulation ability and target manipulation ability set in association with the manipulation ability, and a plurality of data groups including manipulation ability past data stored in advance and control parameter past data associated with the manipulation ability past data. This enables a control parameter corresponding to manipulation ability that is ability of manipulation of an operator at that time point or a control parameter corresponding to target manipulation ability to be set for each piece of work by the work machine 100. Then, the assist amount calculation part 55 calculates, and the control command calculation part 56 calculates a control command for operating an object to be controlled by using a manipulation amount of manipulation by an operator and an assist amount calculated using the set control parameter. This makes it possible to appropriately assist manipulation by an operator given to the manipulation device 27 of a work machine according to manipulation ability of the operator.

[Variation]

Although the work machine 100 which is an example of a work machine according to the embodiment of the present disclosure is described above, the present disclosure is not limited to the above embodiment, and includes, for example, a variation as described below.

(A) Regarding Target Manipulation Ability and Target Manipulation Ability Setting Part In the above embodiment, the parameter setting part 54 of a controller sets a control parameter according to target manipulation ability set in association with manipulation ability, but the present disclosure is not limited to such an embodiment. For example, the parameter setting part 54 of a controller may set a control parameter according to manipulation ability instead of target manipulation ability. In this case, target manipulation ability and a target manipulation ability setting part can be omitted.

(B) Regarding Object to be Controlled

In the above embodiment, an object to be controlled includes a pair of proportional valves (for example, the boom proportional valves 24 and 25), a control valve (for example, the boom control valve 23), a hydraulic actuator (for example, the boom cylinder 7), and a movable portion (for example, the boom 4). However, an object to be controlled in the present disclosure is not limited to the specific example in the above embodiment, and may include, for example, the arm proportional valve, the arm control valve, and the arm cylinder 8. Further, an object to be controlled in the present disclosure may include, for example, the bucket proportional valve, the bucket control valve, and the bucket cylinder 9. Furthermore, an object to be controlled in the present disclosure may include, for example, the slewing proportional valve, the slewing control valve, and the slewing motor 11.

(C) Regarding Work Machine

The work machine may include a work machine body and a remote manipulation device arranged at a position away from the work machine body. In this case, the work machine body includes the lower travelling body 1, the upper slewing body 2, and the work device 3 of the work machine 100 illustrated in FIG. 1, and the remote manipulation device includes a plurality of manipulation devices including the boom manipulation device 27, an arm manipulation device, a bucket manipulation device, and a slewing manipulation device. The work machine body may include a part or whole of the work machine controller 50, and the remote manipulation device may include a part or whole of the work machine controller 50. The remote manipulation device may include the display 42. The work machine body is configured to operate based on manipulation by an operator given to a plurality of manipulation devices of the remote manipulation device.

(D) Regarding Data Group

In the above embodiment, a plurality of data groups stored in the data group storage part include a data group related to a plurality pieces of past work of different types of work content, but may include only a data group related to a plurality pieces of past work of the same work content.

(E) Regarding Manipulation Amount Information and Work Load Information

In a case where the work machine 100 carries out suspended load carrying work, the work machine controller 50 may adjust an opening degree of a plurality of control valves according to a weight (work load) of a suspended load, and perform assist control such that a movable portion operates at a speed corresponding to manipulation ability of an operator. By the above, even an unskilled operator can perform work that does not suddenly stop a movable portion like a skilled operator.

As described above, according to the present disclosure, a work machine control system, a work machine, a management device, and a work machine control method capable of appropriately assisting manipulation by an operator given to a manipulation device of the work machine according to manipulation ability of the operator.

Provided is a control system for controlling a work machine, the work machine control system including a manipulation device to which manipulation for operating an object to be controlled in the work machine is given by an operator, and a controller, in which the controller may include a manipulation ability determination part that determines manipulation ability of the operator, a data group storage part that stores a plurality of data groups related to past work, each of the plurality of data groups including manipulation ability past data in the past work and control parameter past data associated with the manipulation ability past data, a parameter setting part that sets a control parameter by using the plurality of data groups and operation information that is information including the manipulation ability, an assist amount calculation part that calculates, by using the control parameter, an assist amount for assisting the manipulation by the operator, and a control command calculation part that calculates a control command for operating the object to be controlled by using the assist amount and a manipulation amount of the manipulation given to the manipulation device, and inputs the control command to the object to be controlled.

In this work machine control system, the controller determines manipulation ability of an operator for each piece of work by a work machine, and sets a control parameter by using operation information including the manipulation ability and a plurality of data groups including manipulation ability past data stored in advance and control parameter past data associated with the manipulation ability past data. This makes it possible to set a control parameter corresponding to manipulation ability of an operator at that time for each piece of work by a work machine. Then, the controller calculates a control command for operating an object to be controlled by using a manipulation amount of manipulation by an operator and an assist amount calculated using the set control parameter. This makes it possible to appropriately assist manipulation by an operator given to the manipulation device of a work machine according to manipulation ability of the operator.

Preferably, the controller further includes a work content determination part that determines work content which is content of work performed by the work machine, the operation information further includes the work content, and each of the plurality of data groups further includes work content past data in the past work. In this configuration, the controller can set a control parameter according to manipulation ability and work content by using operation information and a plurality of data groups. That is, in this configuration, since the controller determines work content for each piece of work by the work machine, the controller can set a control parameter in consideration of not only manipulation ability but also work content. By the above, manipulation by an operator can be more appropriately assisted according to manipulation ability of the operator and work content.

Preferably, the controller selects at least one data group suitable for the operation information from the plurality of data groups, and sets the control parameter by using the control parameter past data included in the selected at least one data group. Specifically, the controller more preferably selects, from the plurality of data groups, at least one data group including the work content past data corresponding to the work content and suitable for the determined manipulation ability or target manipulation ability set in association with the manipulation ability, and sets the control parameter by using the control parameter past data included in the selected at least one data group. In this configuration, a data group having low relevance to work content (current work content) of actually performed work is omitted from a plurality of data groups, and at least one data group including work content past data corresponding to the current work content is selected. Then, the control parameter is set using control parameter past data included in the selected at least one data group. By the above, in the assist control that assists manipulation by an operator, a load of calculation by the controller can be reduced.

Preferably, the controller selects two or more data groups suitable for the operation information from the plurality of data groups, and sets the control parameter by using the control parameter past data included in the selected two or more data groups. Specifically, the controller preferably selects two or more data groups suitable for the manipulation ability or target manipulation ability set in association with the manipulation ability from the plurality of data groups, and sets the control parameter by using the control parameter past data included in the selected two or more data groups. In this configuration, even in a case where there is no data group including manipulation ability past data that matches current manipulation ability of an operator in actually performed work in a plurality of data groups, two or more data groups including manipulation ability past data close to the current manipulation ability are selected from a plurality of data groups, and a control parameter can be set using a plurality of pieces of control parameter past data included in the two or more data groups.

Preferably, the controller further includes a target setting part that sets target manipulation ability in association with the manipulation ability, and the controller sets the control parameter according to the target manipulation ability. In this configuration, it is possible to set a control parameter according to target manipulation ability in which a degree of manipulation ability is increased or decreased with respect to current manipulation ability of an operator who performs work by the work machine.

Preferably, the work machine control system further includes a target input device capable of inputting a target of the manipulation ability, and the controller sets the target manipulation ability by using the input target of the manipulation ability and the manipulation ability. In this configuration, for example, an operator or a work related person related to work by the operator can input a target of the manipulation ability into the target input device, so that it is possible to set a control parameter reflecting an intention of the operator or the work related person.

The work machine control system preferably further includes a display that displays the manipulation ability. In this configuration, an operator or a work related person can set a control parameter reflecting his or her intention while checking manipulation ability displayed on the display.

The plurality of data groups preferably include a data group related to another operator different from the operator. In this configuration, since a data group related to another operator other than the operator can be used, a data group can be efficiently accumulated, and, for work content that is not experienced by the operator, a control parameter is appropriately set using a data group related to another operator. By the above, in a case where experience of current work content is small, manipulation by an operator can be appropriately assisted according to manipulation ability of the operator.

Preferably, the controller includes a work machine storage part that is mounted on the work machine and stores the operation information, a work machine communication part mounted on the work machine, and a data group storage part that is mounted in a management device arranged at a place away from the work machine and stores the plurality of data groups, and the work machine communication part transmits the operation information stored in the work machine storage part to the management device when work by the work machine is finished or interrupted. In this configuration, if the work machine does not include the data group storage part that stores a plurality of data groups, the work machine can appropriately assist manipulation by an operator according to manipulation ability of the operator by exchanging data with a management device when necessary.

A work machine to be provided includes a manipulation device to which manipulation for operating an object to be controlled in a work machine is given by an operator, and a work machine controller, in which the work machine controller includes a manipulation ability determination part that determines manipulation ability of the operator, the parameter setting part that sets a control parameter by using at least one data group selected, from a plurality of data groups related to past work, according to operation information that is information including the manipulation ability, each of the plurality of data groups including manipulation ability past data and control parameter past data associated with the manipulation ability past data, an assist amount calculation part that calculates, by using the control parameter, an assist amount for assisting the manipulation by the operator, and a control command calculation part that calculates a control command for operating the object to be controlled by using the assist amount and a manipulation amount of the manipulation given to the manipulation device, and inputs the control command to the object to be controlled. In the work machine, manipulation by an operator given to the manipulation device of the work machine can be appropriately assisted according to manipulation ability of the operator.

Provided is a management device used in the work machine control system and arranged at a place away from the work machine, the management device including a data group storage part that stores the plurality of data groups. Since the management device includes the data group storage part, capacity of a memory required for the work machine can be reduced.

Preferably, the management device further includes a management device communication part that is a communication part that receives the operation information transmitted from the work machine, and a data group setting part that sets a target data group that is a data group suitable for the operation information of the work machine by using the plurality of data groups, and the management device communication part transmits the set target data group to the work machine. Since the management device sets a target data group, which is a data group suitable for operation information of the work machine, by using a plurality of data groups, it is possible to reduce a calculation load of the work machine.

Provided is a work machine control method for assisting manipulation by an operator for operating an object to be controlled in a work machine, the work machine control method including: storing a plurality of data groups related to past work, each of the plurality of data groups including manipulation ability past data and control parameter past data associated with the manipulation ability past data, determining manipulation ability of the operator, setting a control parameter by using the plurality of data groups and operation information that is information including the manipulation ability, calculating, by using the control parameter, an assist amount for assisting the manipulation by the operator, and calculating a control command for operating the object to be controlled by using a manipulation amount of the manipulation and the assist amount, and inputting the control command to the object to be controlled. In the work machine control method, manipulation by an operator given to the manipulation device of the work machine can be appropriately assisted according to manipulation ability of the operator.

The invention claimed is:

1. A work machine control system for controlling a work machine, the work machine control system comprising:

a manipulation device to which manipulation for operating an object to be controlled in the work machine is given by an operator; and a controller, wherein the controller:

stores a plurality of data groups related to past work, each of the plurality of data groups including manipulation ability past data and control parameter past data associated with the manipulation ability past data;

determines manipulation ability of the operator;

sets, in association with the manipulation ability, target manipulation ability in which a degree of the manipulation ability is increased or decreased with respect to the current manipulation ability of the operator who performs work by the work machine;

sets a control parameter according to the target manipulation ability by using the plurality of data groups and operation information that is information including the manipulation ability;

calculates, by using the control parameter, an assist amount for assisting the manipulation by the operator; and calculates a control command for operating the object to be controlled by using the assist amount and a manipulation amount of the manipulation given to the manipulation device, and inputs the control command to the object to be controlled.

2. The work machine control system according to claim 1, wherein the controller determines work content which is content of work performed by the work machine, the operation information further includes the work content, and each of the plurality of data groups further includes work content past data.

3. The work machine control system according to claim 1, wherein the controller selects at least one data group suitable for the operation information from the plurality of data groups, and sets the control parameter by using the control parameter past data included in the selected at least one data group.

4. The work machine control system according to claim 1, wherein the controller selects two or more data groups suitable for the operation information from the plurality of data groups, and sets the control parameter by using the control parameter past data included in the selected two or more data groups.

5. The work machine control system according to claim 1, further comprising a target input device capable of inputting a target of the manipulation ability, wherein the controller sets the target manipulation ability by using the input target of the manipulation ability and the manipulation ability.

6. The work machine control system according to claim 5, further comprising a display that displays the manipulation ability.

7. The work machine control system according to claim 1, wherein the plurality of data groups include a data group related to another operator different from the operator.

8. The work machine control system according to claim 1, wherein the controller includes:

a work machine storage part that is mounted on the work machine and stores the operation information; and a data group storage that is mounted in a management device arranged at a place away from the work machine and stores the plurality of data groups, wherein the work machine transmits the operation information stored in the work machine storage to the management device when work by the work machine is finished or interrupted.

9. A management device used in a work machine control system and arranged at a place away from a work machine, the work machine control system including:

a manipulation device to which manipulation for operating an object to be controlled in the work machine is given by an operator; and a controller, wherein the controller:

stores a plurality of data groups related to past work, each of the plurality of data groups including manipulation ability past data and control parameter past data associated with the manipulation ability past data;

determines manipulation ability of the operator;

sets a control parameter by using the plurality of data groups and operation information that is information including the manipulation ability;

calculates, by using the control parameter, an assist amount for assisting the manipulation by the operator; and calculates a control command for operating the object to be controlled by using the assist amount and a manipulation amount of the manipulation given to the manipulation device, and inputs the control command to the object to be controlled, the management device comprising a data group storage that stores the plurality of data groups, wherein the management device:

receives the operation information transmitted from the work machine;

sets a target data group that is a data group suitable for the operation information of the work machine by using the plurality of data groups, and transmits the set target data group to the work machine.

10. A work machine control method for assisting manipulation by an operator for operating an object to be controlled in a work machine, the work machine control method comprising:

storing a plurality of data groups related to past work, each of the plurality of data groups including manipulation ability past data and control parameter past data associated with the manipulation ability past data;

determining manipulation ability of the operator;

setting, in association with the manipulation ability, target manipulation ability in which a degree of the manipulation ability is increased or decreased with respect to the current manipulation ability of the operator who performs work by the work machine;

setting a control parameter according to the target manipulation ability by using the plurality of data groups and operation information that is information including the manipulation ability;

calculating, by using the control parameter, an assist amount for assisting the manipulation by the operator; and calculating a control command for operating the object to be controlled by using a manipulation amount of the manipulation and the assist amount, and inputting the control command to the object to be controlled.

* * * * *